United States Patent [19]

Tharp

[11] 4,326,183

[45] Apr. 20, 1982

[54] CIRCUIT BREAKER WITH SELF CONTAINED ADJUSTABLE BIMETAL

[75] Inventor: James A. Tharp, Cedar Rapids, Iowa

[73] Assignee: Square D Company, Palatine, Ill.

[21] Appl. No.: 182,568

[22] Filed: Aug. 29, 1980

[51] Int. Cl.[3] ..... H01H 71/16

[52] U.S. Cl. ..... 337/70; 335/43; 335/45

[58] Field of Search ..... 337/70, 76, 46, 55, 337/128, 356; 335/43, 45

[56] References Cited

U.S. PATENT DOCUMENTS

| | | | |
|---|---|---|---|
| 2,370,024 | 2/1945 | Dyer | 335/43 |
| 2,406,325 | 8/1946 | Dorfman | 337/70 |
| 2,667,548 | 1/1954 | Page | 337/70 |
| 3,341,791 | 9/1967 | Leonard | 335/174 |

*Primary Examiner*—Harold Broome

*Attorney, Agent, or Firm*—Larry I. Golden; Norton Lesser; Richard T. Guttman

[57] ABSTRACT

An electric circuit breaker including a U-shaped bimetal operably associated with a trip crossbar to effect rotation of the crossbar and subsequent opening of breaker contacts in response to heating of the bimetal to a predetermined temperature by the passage of an electrical current of a selected magnitude therethrough. The bimetal provides self-contained adjustment through the use of a calibration screw threaded into the lower leg of the bimetal which exerts force through an insulating member to the upper leg of the bimetal permitting ready calibration of the bimetal according to ampere rating of the particular circuit breaker.

6 Claims, 6 Drawing Figures

CIRCUIT BREAKER WITH SELF CONTAINED ADJUSTABLE BIMETAL

BACKGROUND OF THE INVENTION

1. Field of the Invention

This invention relates to a circuit breaker including a bimetal trip triggering mechanism and more particularly, it pertains to a circuit breaker having a U-shaped bimetal which is adapted for self contained adjustment without reliance on adjacent parts for calibration.

2. Description of the Prior Art

Most conventional electrical circuit breakers do not include bimetals which change the direction of current flow 180°. The 180° directional change gives rise to magnetic forces tending to separate the conducting members so associated. Exemplary of a breaker incorporating a bimetal which changes the current path approximately 180° in U.S. Pat. No. 3,341,791, issued Sept. 12, 1967 to J. H. Leonard and assigned to the same assignee as the instant invention.

In more common useage are straight bimetals which further extend the current in its existing direction and those that change the direction by approxmately 90°. These types of bimetals avoid the aforementioned magnetic forces. However, they also dictate different locations for cooperating parts which preclude use of the space efficient design shown in the aforementioned Leonard reference.

Furthermore, most circuit breakers rely on adjacent parts for the purpose of adjustment of the bimetal member. Adjustment of the typical thermostat element is generally accomplished after the thermostat element and associated parts have been securely mounted within the circuit breaker case. Often these elements are completely enclosed by housing parts which are fixedly secured together. Accordingly, initial and subsequent calibrations of the bimetal must be made in a restrictive environment.

SUMMARY OF THE INVENTION

It has been found that this invention provides many advantages over the art with the introduction of a bimetal which comprises a U-shaped thermostat element having a tapped hole in one leg through which an adjustment screw is threaded. A thin insulation strip is positioned to prevent engagement of the screw with the second leg of the bimetal.

The U-shaped bimetal incorporated in the instant invention provides a larger final deflection than the conventionally straight bimetal while occupying approximately the same space.

Additionally, the gap between the legs of the bimetal in accordance with this invention has been substantially increased over the gap between the bimetal and load terminal subassembly found in conventional bimetal assemblies which change the direction of current 180°. This effectively reduces magnetic forces which tend to separate the legs of the bimetal and renders unnecessary cutting out a portion of the conventional subassembly in order to reduce such magnetic forces.

DESCRIPTION OF THE PREFERRED EMBODIMENT

Figures 1, 2, 3, 4:
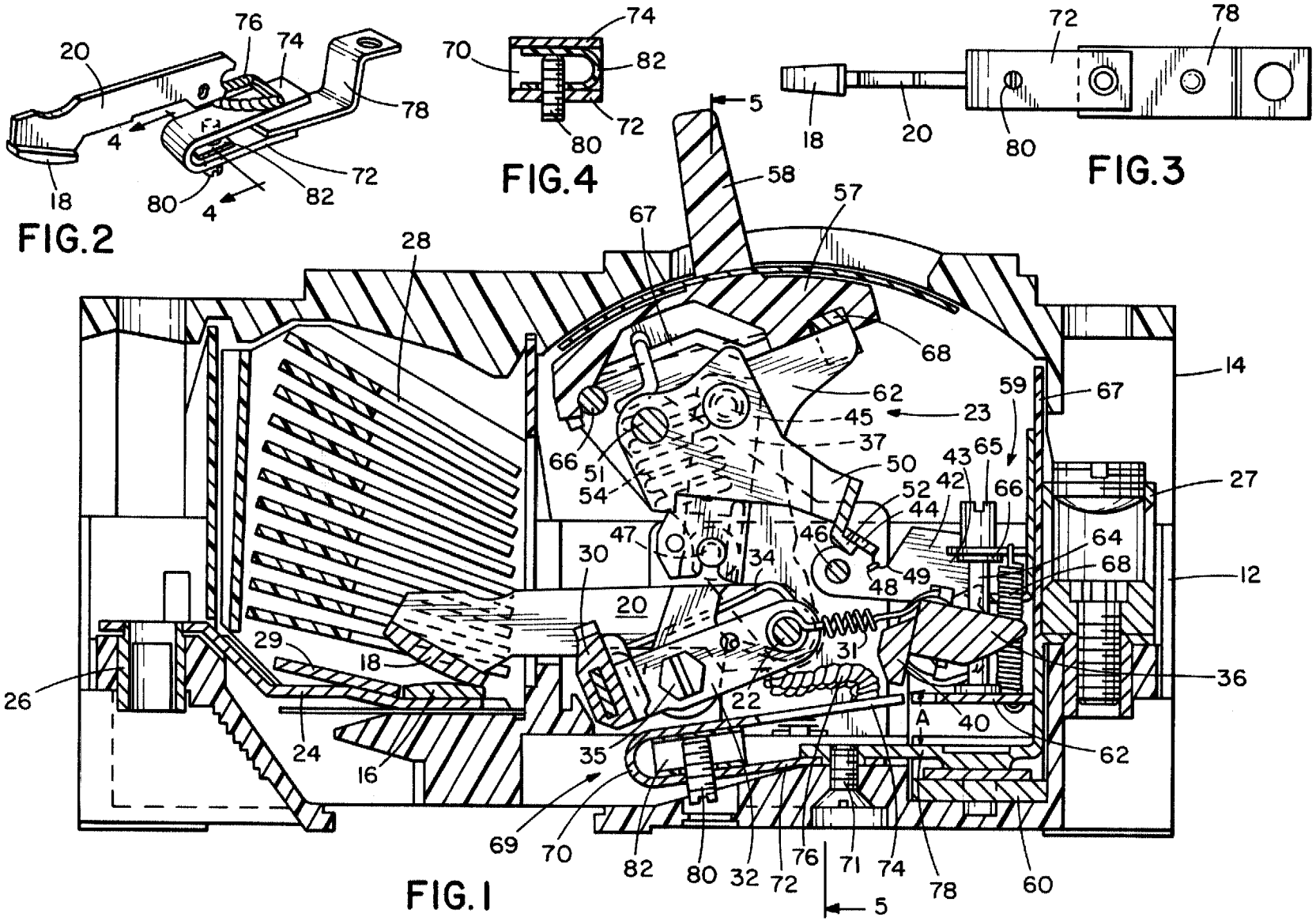
FIG. 1 is a side sectional view of the center pole of a circuit breaker incorporating an adjustable bimetal constructed in accordance with the invention.
FIG. 2 is a perspective view of the bimetal together with the connecting contact blade and load terminal subassembly.
FIG. 3 is a bottom view of the bimetal and associated parts shown in FIG. 2.
FIG. 4 is a cross sectional view of the bimetal assembly taken generally along the line 4—4 of FIG. 2.

Turning now to FIG. 1 of the Drawings, the center pole of a three pole breaker, generally indicated by reference character 10, is used for illustrative purposes only. It will be obvious that various aspects of the invention are equally applicable to circuit breakers having a different number of poles. The three pole breaker constructed in accordance with this invention includes a two part case having a base 12 and cover 14, preferably molded of an insulating material. This breaker, aside from the bimetal assembly, is such the same as shown in the aforementioned Leonard patent.

The breaker provides for the extension of current from a line terminal 26 to a load terminal 27 through a pair of contacts which includes stationary contact 16 and movable contact 18. Stationary contact 16 is secured to one end of bronze line terminal strap 24, with the other end of the terminal strap secured to line terminal 26. Movable contact 18 is carried adjacent the free end of movable contact blade 20 which is pivotally mounted adjacent an opposite end on contact pin 22 to place contact 18 in engageable association with stationary contact 16.

An arc runner 29 is provided on terminal strap 24, adjacent stationary contact 16 and on the line side thereof. An arc chute including a plurality of ferrous de-ionizing plates 28 mounted in insulating fiberboard members, not shown, is provided for each set of contacts in the breaker.

An over-center spring mechanism, indicated generally by 23, operatively provides for the resetting of contacts 16 and 18 through movement of a handle 58. Handle 58 includes a shoulder portion 57 which is supported on a handle arm assembly which includes a pair of generally triangular handle arm members 62 and 64 pivotally mounted on contact blade pin 22. A handle pin 66 is rigidly mounted adjacent one end of the handle arm members connecting the same and providing support for a T-shaped spring support member 67 which is partially curved around pin 66 and has opposite end portions 68 at the head of the T which are bent over to engage the end portion of the handle arm members 62 and 64.

As stated, the contact arm or blade of the center pole is pivotally mounted adjacent one end on pin 22. Also mounted on pin 22 is a generally U-shaped drive arm 32 for a contact arm crossbar 30. The free end portions of leg portions of the drive arm 32 being pivotally mounted on pin 22 and the bight portion of drive arm 32 being riveted or otherwise secured to crossbar 30.

Each contact arm is resiliently secured to the crossbar 30 by hairpin shaped or generally U-shaped springs 34 having a bight portion disposed in a suitable notch in the end of the respective contact arm 20 opposite from the contact 18. The leg portions of each spring 34 are disposed on opposite sides of the respective contact arm and are resiliently curved over pin 22, the free end portion of the leg portions of each spring 34 being received and held in crossbar 30.

Figure 5:
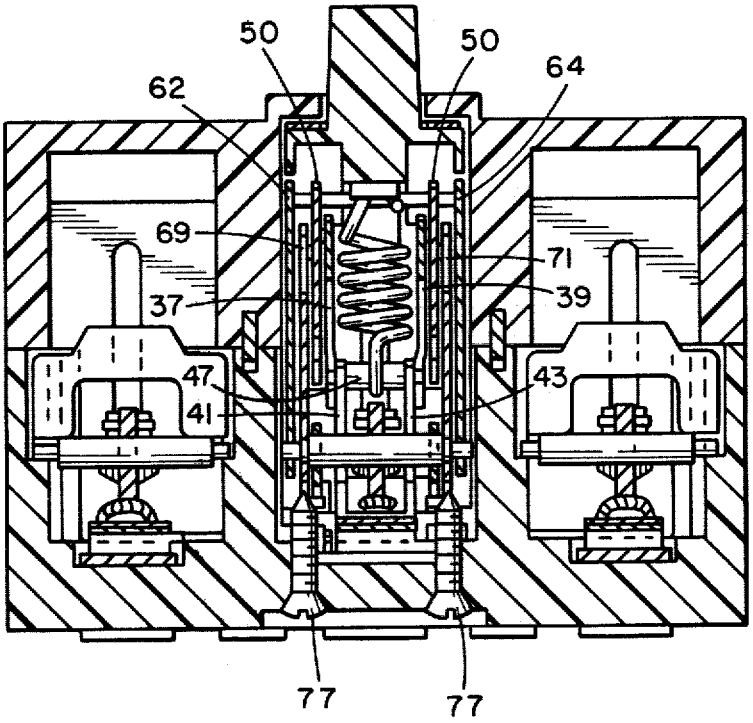
FIG. 5 is a sectional view taken generally along lines 5—5 of FIG. 1.

The contact arm pin 22 is mounted in a pair of stationary frame members 69 and 71 which are respectively disposed inwardly of, but closely adjacent, the handle arm members 62 and 64. They are respectively secured to the base 12 by a pair of screws 77, as best shown in FIG. 5. The screws 77 are preferably self tapping, and the frame members 69 and 71 being lanced to provide oppositely projecting loops into which the screws 77 are threaded.

A generally U-shaped trip lever 50 is pivotally mounted on frame member 69 and 71 by rivets 51 or some other such mounting device. Trip lever 50 is provided with a tongue 52 which extends toward the load terminal of the breaker and is adapted to be retained by latch member 42 having a bight portion 44 which engages the top portion of tongue 52 and prevents pivotal movement of trip lever 50 when the contacts are in the closed position. Latch member 42 is pivotally mounted on pin 46 which is supported by frame members 69 and 71.

Latch member 42 includes a follower portion 43 extending outward from the pin 46 toward the load terminal of the breaker. The follower 43 includes a double tanged section associated with a trip crossbar 36 which extends across all three poles of the breaker.

As shown in FIG. 1, trip crossbar 36 is biased toward counterclockwise rotation by spring 31 which is connected at one of its ends to contact pin 22 located in one of the end poles of the breaker and at the other of its end to the top portion of crossbar 36. As seen in FIG. 1, latch member 42 is biased in the clockwise direction by spring 48 which is helically wound about pin 46 with one of its ends connected to frame member 71 and the other of its ends biasing latch member 42 at a notch portion 49 of latch member 42.

A pair of upper links 37 and 39 are pivotally mounted adjacent their upper ends on trip lever 50 by rivets 45 or some other similar fastening device. The lower end portions of the links 37 and 39 are pivotally mounted on a toggle pin 47. Spring 54 is secured at one end to spring support member 67 and at an opposite end to toggle pin 47.

Lower links 41 and 43 are pivotally mounted adjacent their upper end on toggle pin 47 and adjacent their lower ends on pin 35, the opposite ends of which are mounted respectively in the opposite leg portions of drive arm 32 adjacent the bight portion of the drive arm.

When the contacts are in a tripped open position and handle 58 is moved toward the load side, tongue 52 of pin 66 causes trip lever 50 to pivot about pin 51 causing upper links 37 and 39 to place spring 54 in tension through movement of toggle pin 47 to a spring tension position. Trip lever 50 engages bight portion 44 of latch member 42, pulling it in a counterclockwise direction and enabling spring 31 to rotate trip crossbar 36 in the counterclockwise direction which brings the trip crossbar into an engaged position with the lower tang of follower 43 and prevents spring 48 from rotating latch 42 in the clockwise direction which would release tongue 52. Accordingly, spring 54 remains in a tension state until tongue 52 is released from bight portion 44 of latch member 42. Contacts 16 and 18 are closed by the over center spring mechanism when the handle is moved toward the line side or to the contact closed position while tongue 52 is retained by bight portion 44 of latch member 42.

When trip crossbar 36 is rotated in the clockwise direction, it becomes disengaged from the lower tang of follower 43 enabling spring 48 to bring latch 42 out of its retaining position with respect to tongue 52, enabling spring 54 to release its energy and open the contacts.

Trip crossbar 36 is adapted to be rotated in the clockwise direction by either an armature assembly 59 or a bimetal assembly 69. The armature assembly includes an armature 62 which is mounted on an armature rod 64 and attracted by the pull of generally U-shaped magnetic core 60. The rod includes a sleeve 65 threadingly connected to the top portion of the rod. The sleeve extends through an opening in an L-shaped bracket 67 which is secured adjacent the load side of the case. A spring 68 is connected at one end to the bracket 67 and at an opposite end to the armature 62 in order to bias the armature away from core 60, while a shoulder 66 is provided on sleeve 65 in order to limit the upward movement of armature 62.

The bimetal assembly 69 completes the circuit from contact arm 20 to the load terminal of the breaker. A pigtail 76 is connected to contact blade 20 at a point adjacent pin 22 and also is connected to a generally U-shaped bimetal 70 adjacent the end of an upper leg 74. The lower leg 72 of the bimetal 70 is brazenly secured adjacent its end to a terminal subassembly 78 which in turn is connected to load terminal 27 at its opposite end. The subassembly and bimetal are secured in the case by a screw 71. The distal end portion of the upper leg 74 of the bimetal is associated with a finger portion 40 of trip crossbar 36 such that a predetermined amount of upward deflection of leg portion 74 will rotate trip crossbar 36 in the clockwise direction disengaging the crossbar from the lower tang of latch member 42 causing spring 48 to rotate latch 42 clockwise to effect release of tongue 52, thereby opening the contacts 16 and 18 if they were in the closed position and preventing the closing of the contacts until tongue 52 is relatched by bight portion 44 of latch 42 by moving handle 58 to the reset position.

Figure 6:
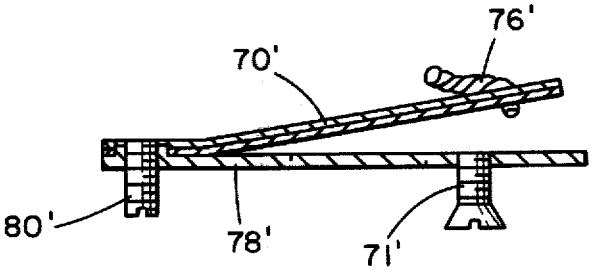
FIG. 6 (PRIOR ART)
FIG. 6 is exemplary of prior art bimetals used in circuit breakers.

The earlier referenced Leonard patent, No. 3,341,791, is exemplary of a prior art bimetal which reverses the current approximately 180°. This type of bimetal is shown in FIG. 6 of the Drawings. The figure shows the bimetal 70', connecting pigtail 76', adjustment screw 80' and a portion of terminal subassembly 78' together with fastener 71'. It is in the interest of efficient use of available space that this type of bimetal is used as opposed to a straight bimetal or one which alters current direction by 90°. In order to reduce the separating effect of the magnetic forces caused by current flow through the subassembly and bimetal shown in FIG. 6, a portion of the subassembly is cutout. The use of a U-shaped bimetal as described in the instant application, has been found to provide superior results to those found in the prior art. It facilitates additional bimetal length within a smaller amount of space, thereby producing a greater amount of deflection of leg portion 74 which substantially increase tolerances with respect to initial and any subsequent calibrations.

Dimension A, shown in FIG. 1 of the drawings, can be readily determined for circuit breakers of various ampere ratings. Of course, distance A will be dependent upon properties of the particular bimetal used as well as the amount of deflection necessary for the bimetal to rotate the trip crossbar. Bimetals are commercially available and often come in strips which can be cut and formed into the U-shape for use in the circuit breaker environment.

The bimetal assembly of the instant invention also provides self contained adjustability. Lower leg 72 of bimetal 70 includes a threaded aperture 81 which receives a screw 80 threaded therein to adjust the bimetal. A generally U-shaped insulating strip 82 is sandwiched between the legs of bimetal 70, preventing screw 80 from making a second electrical connection from lower leg 72 to upper leg 74. The lower leg of insulating member 82 includes an aperture in registration with aperture 81 and through which screw 80 passes. Screw 80 thereby maintains strip 82 in an insulating position.

In view of the increased tolerances provided by the greater deflection of the subject bimetal and the self contained adjustability feature, the bimetal may be calibrated prior to assembly without reliance on adjacent parts in the breaker. The bimetal can be preadjusted for a particular breaker rating.

Additionally, because adjustment screw 80 bears directly against upper leg 74 of the bimetal, a greater deflection results from a specified amount of rotation of the adjustment screw than in the prior art bimetal as shown in FIG. 6 which indirectly adjusts the bimetal by bearing the non-slotted end of adjustment screw 80' against a portion of insulating case 12.

It is understood that various modifications may be made in the structure shown and described herein without departing from the spirit and scope of the invention, and it is intended that these modifications are intended to be comprehended within the meaning and range of equivalents of the appended claims.

What is claimed is:

1. An electric circuit breaker comprising:

an insulating case;

a line terminal carried by said case;

a load terminal carried by said case;

a stationary contact connected to said line terminal;

a movable contact arm in said case pivotally supported adjacent one end of said arm and connected to said load terminal;

a movable contact carried by said contact arm adjacent an opposite end of said arm for engagement with said stationary contact to extend an electrical connection between said line terminal and said load terminal in response to said contact arm being in one pivotal position and to interrupt said connection in response to said contact arm being in an other position;

a toggle mechanism including a main toggle spring, said mechanism having a first position in which said spring is energized and said contact arm is in said other position and a third position in which said spring is deenergized and said contact arm is in said other position;

a latch having a first latch position for retaining said toggle mechanism in either said first or said second position, said latch biased toward a second latch position to enable release of the energy of said spring for moving said toggle mechanism to said third position;

a trip crossbar supporting said latch in said first latch position and rotatable to release said latch whereby said toggle mechanism moves to said third position;

a generally U-shaped bimetal connected intermediate and in series with said contact arm and said load terminal;

said bimetal having a lower leg fastened to said frame and an upper leg spaced a predetermined distance from said trip crossbar in operative association with said crossbar to rotate said crossbar to effect release of said latch in response to heating of the bimetal to a predetermined temperature by the passage of an electrical current of a selected magnitude therethrough;

said lower leg having portions defining a threaded aperture; a screw threaded through said aperture; and an insulator interposed between said screw and said upper leg.

2. An electric circuit breaker as claimed in claim 1, wherein said insulator is generally U-shaped with a top leg and a bottom leg, said insulator being interposed between said upper and lower legs of said bimetal, said top leg in facing relationship to said upper leg and said bottom leg in facing relationship to said lower leg.

3. An electric circuit breaker as claimed in claim 2, wherein said insulator includes portions defining an aperture in said bottom leg through which said screw passes thereby maintaining said insulator in said interposed position with respect to said upper leg and said screw.

4. An electric circuit breaker comprising;

an insulating case;

a line terminal carried by said case;

a load terminal carried by said case;

a stationary contact connected to said line terminal;

a movable contact arm in said case pivotally supported adjacent one end of said arm and connected to said load terminal;

a movable contact carried by said contact arm adjacent an opposite end of said arm for engagement with said stationary contact to extend an electrical connection between said line terminal and said load terminal in response to said contact arm being in one pivotal position and to interrupt said connection in response to said contact arm being in an other position;

toggle means for selectively placing said contact arm in said one pivotal position or said other position;

a latch having a first position for enabling said toggle means to retain said contact arm in said one pivotal position, said latch biased toward a second position enabling said toggle means to place said contact arm in said other position;

a trip crossbar supporting said latch in said first position and rotatable to release said latch whereby said toggle means places said contact arm in said other position; and a generally U-shaped bimetal connected intermediate and in series with said contact arm and said load terminal;

said bimetal having a lower leg fastened to said frame and an upper leg spaced a predetermined distance from said trip crossbar in operative association with said crossbar to rotate said crossbar in effect release of said latch in response to heating of the bimetal to a predetermined temperature bv the passage of an electrical current of a selected magnitude therethrough, said lower leg having portions defining a threaded aperture; a screw threaded through said aperture;

and an insulator interposed between said screw and said upper leg.

5. An electric circuit breaker as claimed in claim 4, wherein said insulator is generally U-shaped with a top leg and a bottom leg, said insulator being interposed between said upper and lower legs of said bimetal, said top leg in facing relationship to said upper leg and said bottom leg in facing relationship to said lower leg.

6. An electric circuit breaker as claimed in claim 5, wherein said insulator includes portions defining an aperture in said bottom leg through which said screw passes thereby maintaining said insulator in said interposed position with respect to said upper leg and said screw.

* * * * *